US006414583B1

(12) United States Patent
Yeh et al.

(10) Patent No.: US 6,414,583 B1
(45) Date of Patent: Jul. 2, 2002

(54) INDUCTOR

(75) Inventors: Ming Yeh, Banchiau; Allen Chou, Shinjuang; Chen-Feng Wu, Bade; Chien-Chia Lin, Taoyuan, all of (TW)

(73) Assignee: Delta Electronics Inc., Taoyuan Sien (TW)

( * ) Notice: Subject to any disclaimer, the term of this patent is extended or adjusted under 35 U.S.C. 154(b) by 10 days.

(21) Appl. No.: 09/774,305

(22) Filed: Jan. 30, 2001

(30) Foreign Application Priority Data

Aug. 18, 2000 (TW) ..... 89214287 U

(51) Int. Cl.[7] ..... H01F 5/00

(52) U.S. Cl. ..... 336/200; 336/223; 336/232; 336/192

(58) Field of Search ..... 336/192, 200, 336/223, 232, 233, 208; 29/606, 602.1

(56) References Cited

U.S. PATENT DOCUMENTS 4,760,366 A * 7/1988 Mitsui ..... 336/233
5,760,670 A * 6/1998 Yeh et al. ..... 336/134
6,294,975 B1 * 9/2001 Chen ..... 336/198

* cited by examiner

*Primary Examiner*—Anh Mai
(74) *Attorney, Agent, or Firm*—Darby & Darby

(57) ABSTRACT

Disclosed is an inductor without a gap spacer. The inductor includes a bobbin having at least one round of wire wound thereon to serve as a coil of the inductor, a first magnetic member coupled with the bobbin, and a second magnetic member having a first end and a second end, wherein the second magnetic member is inserted into the bobbin from the second end thereof and the first end has a protrusion for allowing the second magnetic member to be partially inserted into the bobbin, thereby forming a gap between these two magnetic members.

18 Claims, 5 Drawing Sheets

INDUCTOR

FIELD OF THE INVENTION

The present invention is related to an inductor, and especially to an inductor without a gap spacer.

BACKGROUND OF THE INVENTION

As shown in FIGS. 1*a* and 1*b*, a conventional inductor 10 includes a bobbin 20, a U-shaped magnetic core member 30, an I-shaped magnetic core member 50, and a spacer 60. Several rounds of wires are wound on the bobbin 20 to be employed as a coil of the inductor 10. Because the magnetic core of the inductor 10 is constituted by the U-shaped magnetic core member 30 and the I-shaped magnetic core member 50, this inductor 10 is commonly called a "UI inductor". The U-shaped magnetic core member 30 has a concavity 35 on a side wall thereof. The U-shaped magnetic core member 30 is engaged with the bobbin 20 but the opening of the central hole of the bobbin 20 is exposed out of the concavity 35 of the U-shaped magnetic core member 30. The spacer 60 is disposed between the adjacent magnetic core members 30, 50 to space the core members out of contact with each other, thereby reducing magnetic interference therebetween. The spacer 60 may be made of a non-magnetic material, such as plastic, aluminum or paint, which does not cause any magnetic interference between the two magnetic core members 30, 50 and the two magnetic core members 30, 50 may be fixed and held through the spacer 60 with a certain space therebetween. Typically, this spacer 60 is made of an insulating material and adhered to one end of the I-shaped magnetic core member 50. The end of the I-shaped magnetic core member 50 with the spacer 60 is inserted into the central hole of the bobbin 20 through the concavity 35 for allowing the spacer 60 to be attached to the U-shaped magnetic core member 30 so as to assemble the inductor 10 as shown in FIG. 1*a*. Briefly, the function of the spacer 60 is to form a gap between the I-shaped magnetic core member 50 and the U-shaped magnetic core member 30 so that the inductance of the inductor 10 can be changed by adjusting the spacer size.

However, when manufacturing such an inductor, there exists some problems as follows.

(1) When the I-shaped magnetic core member 50 is inserted into the hole of the bobbin 20, the spacer 60 may be adhered to the inner wall of the central hole of the bobbin 20 due to its adhesive property. If the I-shaped magnetic core member 50 is forcedly inserted into the bobbin 20, the spacer 60 may be deformed, thereby influencing the thickness of the spacer 60 and generating an error of the gap, so that the predetermined inductance can not be obtained.

(2) It is uneasy to precisely control the length of the I-shaped magnetic core member 50 inserted into the bobbin 20.

(3) One end of the I-shaped magnetic core member 50 is attached to the U-shaped magnetic core member 30 only through the spacer 60. When manufacturing the inductor, the gap may become larger because of the thermal expansion of the spacer so that the inductance of the inductor may be changed.

(4) If the gap is too large or the spacer 60 is too thick, the other end of the I-shaped magnetic core member 50 will be protruded over the edge of the bobbin 20, or even over the pin 70 of the bobbin 20, after inserting the I-shaped magnetic core member 50 into the central hole of the bobbin 20.

(5) The size of the spacer 60 must be matched with that of the central hole of the bobbin 20. If the size of the spacer 60 is too big, the I-shaped magnetic core member 50 can not be smoothly inserted into the central hole of the bobbin 20. If the size of the spacer 60 is too small, the spaced area between the I-shaped magnetic core member 50 and the U-shaped magnetic core member 30 may be insufficient.

Therefore, it is desirable to develop an inductor without any above-described drawbacks and without needing a spacer to form a gap.

SUMMARY OF THE INVENTION

An object of the present invention is to provide an inductor without a gap spacer. According to the present invention, the inductor includes a bobbin having at least one round of wire wound thereon to serve as a coil of the inductor, a first magnetic member coupled with the bobbin, and a second magnetic member having a first end and a second end, wherein the second magnetic member is inserted into the bobbin from its second end and the first end of the second magnetic member has a protrusion for allowing the second magnetic member to be partially inserted into the bobbin.

Preferably, the first magnetic member is a U-shaped type magnetic core member and the second magnetic member is an I-shaped type magnetic core member. The first and second magnetic members are made of one selected from a relatively soft magnetic material, Mn—Zn ferrite, Ni—Zn ferrite and a silicon steel plate, respectively, and employed as a magnetic core of the inductor.

Preferably, the protrusion of the second magnetic member has a recess formed on an upper surface thereof for allowing a tool to be inserted therein so as to grab the second magnetic member. The recess can be a hole.

Preferably, the second magnetic member is shortened in accordance with a thickness of a reference piece so as to form a gap between the second end of the second magnetic member and the first magnetic member. The height of the reference piece is greater than that of the side wall of the first magnetic member with the concavity. Certainly, the reference piece is removed before the inductor is assembled.

The present invention may best be understood through the following description with reference to the accompanying drawings, in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1A:
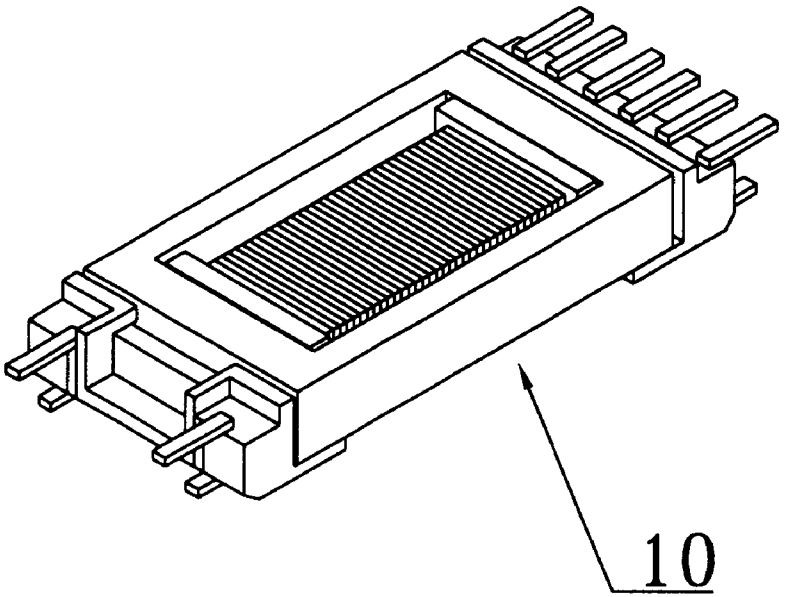
Fig. 1a (Prior Art)
FIG. 1*a* is a perspective view of a conventional UI inductor.
Figure 1B:
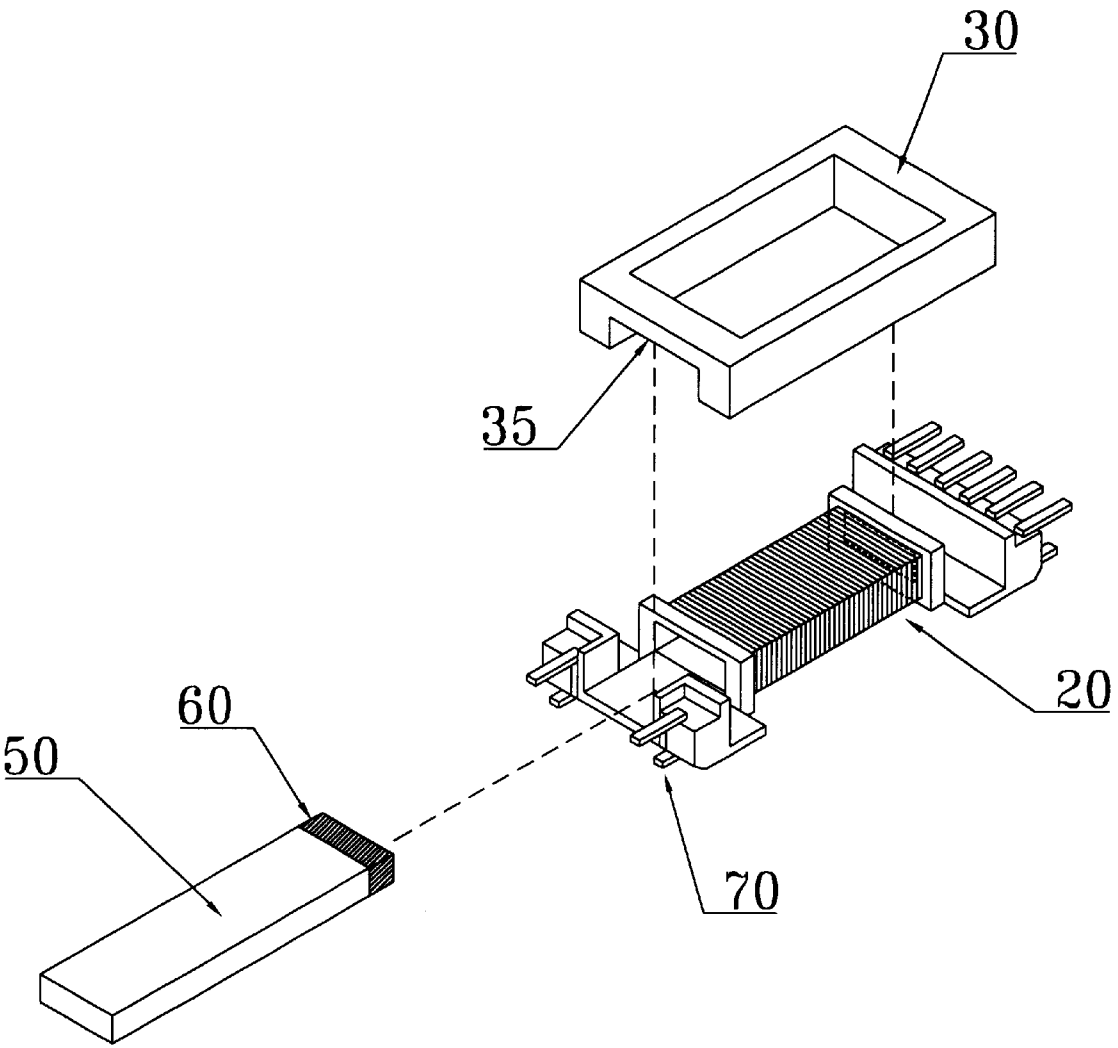
Fig. 1b (Prior Art)
FIG. 1*b* is an exploded view of the conventional UI inductor shown in FIG. 1*a;*
Figure 2A:
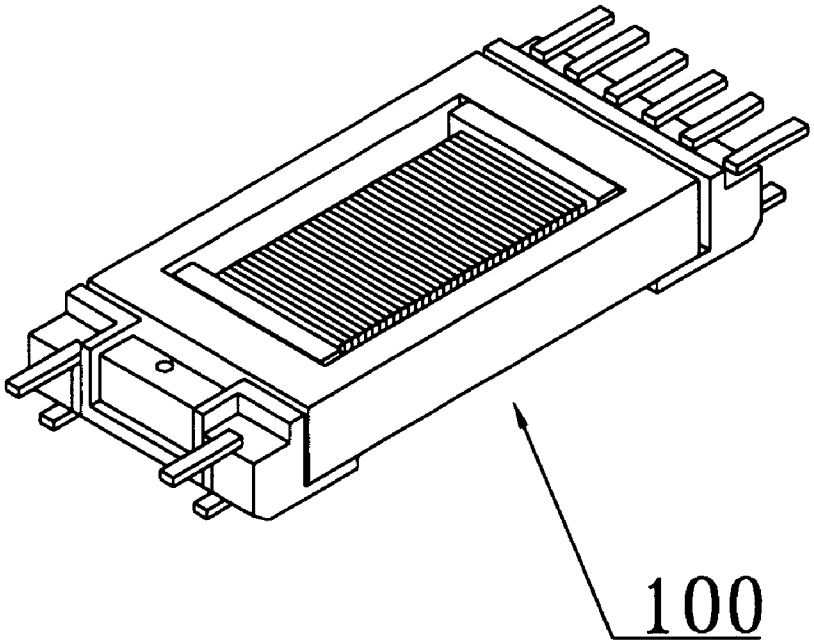
FIG. 2*a* is a perspective view of a preferred embodiment of an inductor according to the present invention.
Figure 2B:
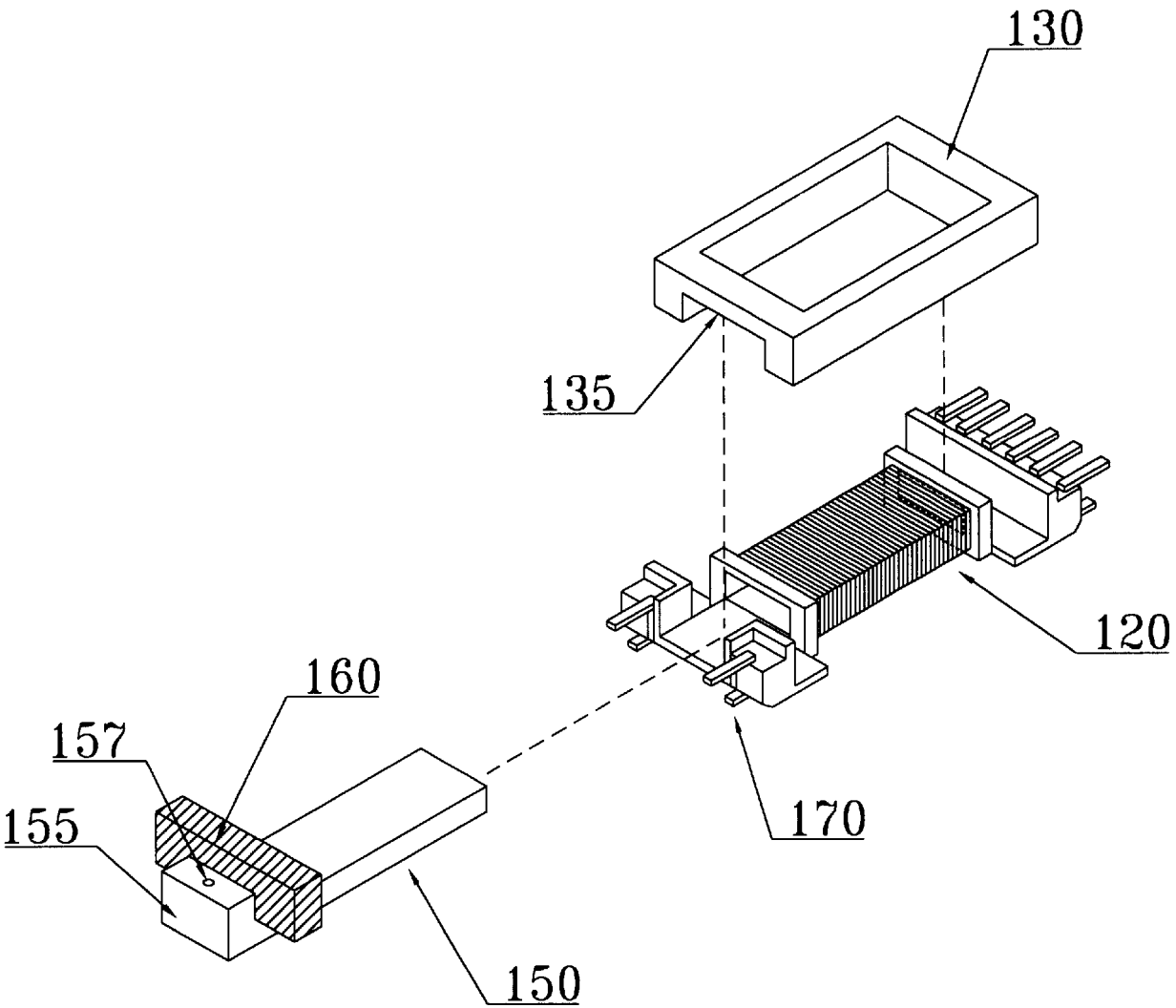
FIG. 2*b* is an exploded diagram showing the first method for manufacturing and assembling the inductor of the present invention.

One preferred embodiment of the inductor of the present invention is shown in FIG. 2*a*. Referring to FIGS. 2*a* and 2*b*, the inductor 100 at least includes a bobbin 120, a first magnetic member 130, and a second magnetic member 150. The bobbin 20 is wound by at least one round of wire which serves as a coil of the inductor 100. The first magnetic member 130 is engaged with the bobbin 120. The first magnetic member 130 has a concavity 135 on one side wall thereof for exposing the opening of the central hole of the bobbin 120. The first magnetic member 130 and the second magnetic member 150 are employed as a magnetic core of the inductor 100. The first and second magnetic members can be made of a soft magnetic material such as Mn—Zn ferrite, Ni—Zn ferrite or silicon steel plate. Preferably, the first and second magnetic members are crosssectionally U- and I-shaped magnetic core members, respectively.

The second magnetic member 150 has a first end and a second end. The first end of the second magnetic member 150 has a protrusion 155, the height of which is high enough to prevent the second magnetic member 150 from being completely inserted into the bobbin 120, that is, the protrusion 155 is stopped by the side wall of the first magnetic member with the concavity 135. The second magnetic member 150 can be inserted into the bobbin 120 from the second end thereof through the concavity 135 of the first magnetic member 130.

When adjusting the inductance of the inductor 100, a reference piece 160 with a suitable thickness is disposed between the protrusion 155 of the second magnetic member 150 and the side wall of the first magnetic member 130 with the concavity 135 and closely attached to both of them so as to form a gap between the second end of the second magnetic member 150 and a side wall of the first magnetic member 130 opposed to that of the first magnetic member 130 with the concavity 135. Thereafter, as a predetermined inductance is obtained, the thickness of the reference piece is measured. The second magnetic member 150 is shortened from the second end thereof according to the thickness of the reference piece 160 so as to form the gap after the shortened second magnetic member 150 is inserted into the bobbin 120. The second magnetic member 150 can be shortened by any prior technique including but not limited to the polishing method.

It should be noted that the reference piece 160 is not the component of the inductor of the present invention but only used to measure the truncated length of the second magnetic member 150. Therefore, it must be easily replaced and does not have the adhesive property. Its height must be greater than that of the side wall of the first magnetic member 130 with the concavity 135. Its shape is not limited and any object with some degree of thickness can be adopted, for example, rectangle (as shown in FIG. 2*b*) or cylinder (as shown in FIG. 2*c*).

Due to the presence of the protrusion 155, the shortened second magnetic member 150 is partially inserted into the bobbin 120. After the shortened second magnetic member 150 is inserted into the bobbin 120, the protrusion 155 will be stopped by the side wall of the first magnetic member 130 with the concavity 135, thereby easily positioning the bobbin 120, the first magnetic member 130, and the second magnetic member 150. In other words, the shortened second magnetic member 150 is pushed into the bobbin 120 until the protrusion 155 is stopped by the side wall of the first magnetic member 130 so as to precisely form the gap. Therefore, it is unnecessary to accurately calculate the length of the second magnetic member 150 inserted into the bobbin 120 like the prior art (or calculate the length of the second magnetic member 150 left out of the bobbin 120) or precisely fix the second magnetic member 150 relative to the first magnetic member 130. If the measured or judged inductance of the inductor does not meet the requirement, the thickness of the reference piece 160 can be increased or decreased or the reference piece 160 is replaced by another one with a more suitable thickness so as to obtain a predetermined inductance value.

Figure 2C:
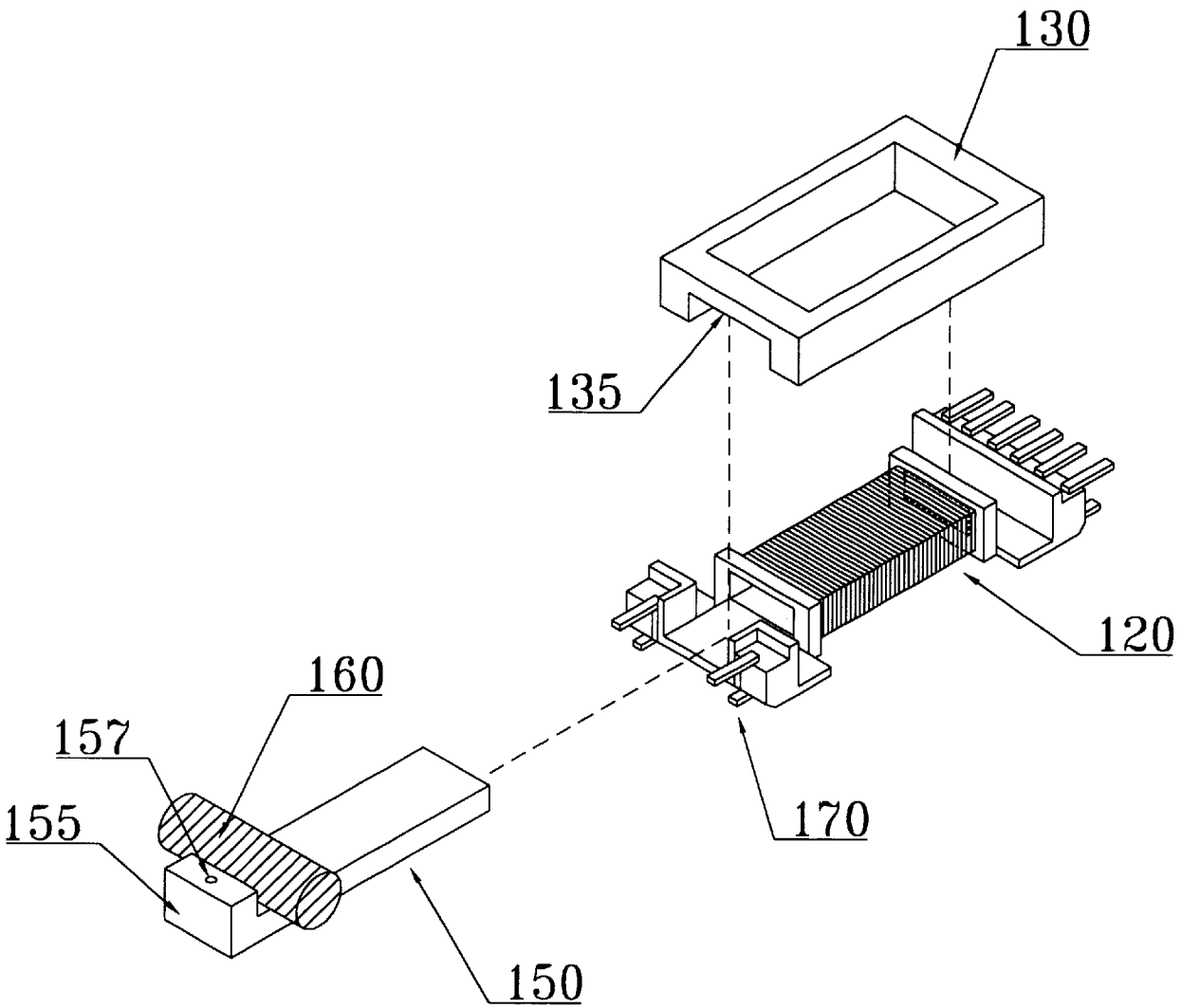
FIG. 2*c* is an exploded diagram showing the second method for manufacturing and assembling the inductor of the present invention.

Specially, there is a recess 157 formed on the upper surface of the protrusion 155 for allowing a suitable tool to be inserted therein in order to grab the second magnetic member 150 as shown in FIGS. 2*a*~2*c*. The recess includes but is not limited to a hole 157 for inserting a needle therein. Therefore, the second magnetic member 150 of the inductor of the present invention can be grabbed by a clip with the needle, which is convenient for the manufacturing process. Certainly, the recess can also have other shapes such as cross, etc.

In conclusion, the design of the present invention can solve the problems encountered by the conventional inductor. First of all, because the inductor of the present invention does not need the gap spacer, some defects caused by the spacer can be eliminated, for instance, the problems caused by the adherence between the spacer and the inner wall of the central hole of the bobbin, the thermal expansion of the spacer, or the portion of the second magnetic member 150 protruded over the edge of the pin of the bobbin. In addition, because the second magnetic member 150 has a protrusion 155, it is easy to control the length of the second magnetic member 150 inserted into the bobbin 120. Furthermore, the reference piece 160 can be used repeatedly and its shape is not limited, thereby simplying the manufacturing process of the inductor. Moreover, the protrusion 155 has a recess for allowing users to insert a tool therein to grab the second magnetic member 150.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inductor comprising:

a bobbin having at least one round of wire wound thereon to serve as a coil of said inductor;

a first magnetic member coupled with said bobbin; and a second magnetic member having a first end and a second end, wherein said second magnetic member is inserted into said bobbin from said second end and said first end has a protrusion for allowing said second magnetic member to be partially inserted into said bobbin so as to form a gap between said first and second magnetic members.

2. The inductor according to claim 1 wherein said first magnetic member is a U-shaped type magnetic core member and said second magnetic member is an I-shaped type magnetic core member.

3. The inductor according to claim 1 wherein said first and second magnetic members are made of one selected from a relatively soft magnetic material, Mn—Zn ferrite, Ni—Zn ferrite and a silicon steel plate, respectively, and employed as a magnetic core of said inductor.

4. The inductor according to claim 1 wherein said protrusion of said second magnetic member has a recess formed on an upper surface thereof for allowing a tool to be inserted therein so as to grab said second magnetic member.

5. The inductor according to claim 4 wherein said recess includes a hole.

6. The inductor according to claim 1 wherein said second magnetic member is shortened in accordance with a thickness of a reference piece so as to form said gap between said first magnetic member and said second magnetic member.

7. The inductor according to claim 6 wherein a height of said reference piece is greater than that of a side wall of said first magnetic member facing said protrusion of said second magnetic member.

8. The inductor according to claim 7 wherein said reference piece is disposed between said protrusion of said second magnetic member and said side wall of the first magnetic member and closely attached to both of them to determine a shortened length of said second magnetic member.

9. The inductor according to claim 8 wherein said reference piece is removed before said inductor is assembled.

10. An inductor comprising:

a bobbin having at least one round of wire wound thereon to serve as a coil of said inductor;

a first magnetic member coupled with said bobbin and having an concavity on a side wall thereof; and a second magnetic member having a first end and a second end, wherein said second magnetic member is inserted into said bobbin from said second end thereof through said concavity of said first magnetic member and said first end of said second magnetic member has a protrusion which will be stopped by said side wall of said first magnetic member as said second magnetic member is inserted into said bobbin so that said second magnetic member is partially inserted into said bobbin to form a gap between said first and second magnetic members.

11. The inductor according to claim 10 wherein said protrusion of said second magnetic member has a recess formed on an upper surface thereof for allowing a tool to be inserted therein so as to grab said second magnetic member.

12. The inductor according to claim 11 wherein said recess includes a hole.

13. The inductor according to claim 10 wherein said second magnetic member is shortened in accordance with a thickness of a reference piece so as to form said gap between said first magnetic member and said second magnetic member.

14. The inductor according to claim 13 wherein a height of said reference piece is greater than that of said side wall of said first magnetic member with said concavity.

15. The inductor according to claim 13 wherein said reference piece is disposed between said protrusion of said second magnetic member and said side wall of the first magnetic member and closely attached to both of them to determine a shortened length of said second magnetic member.

16. The inductor according to claim 15 wherein said reference piece is removed before said inductor is assembled.

17. The inductor according to claim 10 wherein said first magnetic member is a U-shaped type magnetic core member and said second magnetic member is an I-shaped type magnetic core member.

18. The inductor according to claim 10 wherein said first and second magnetic members are made of one selected from a relatively soft magnetic material, Mn—Zn ferrite, Ni—Zn ferrite and a silicon steel plate, respectively, and employed as a magnetic core of said inductor.

* * * * *